United States Patent [19]

Tanaka et al.

[11] 4,031,617

[45] June 28, 1977

[54] ELECTRIC SHAVER WITH LONG HAIR TRIMMER

[75] Inventors: Yoshimasa Tanaka, Hikone; Hirozo Imai, Hirakata; Tadao Tsutsumi, Kadoma; Takeshi Oda, Hikone, all of Japan

[73] Assignee: Matsushita Electric Works Ltd., Osaka, Japan

[22] Filed: July 12, 1976

[21] Appl. No.: 704,656

[30] Foreign Application Priority Data

July 12, 1975 Japan ..... 50-97263[U]

[52] U.S. Cl. ..... 30/34.1; 30/41.6; 30/43.92

[51] Int. Cl.[2] ..... B26B 19/10; B26B 19/38

[58] Field of Search ..... 30/34.1, 41.6, 43.91, 30/43.92

[56] References Cited

UNITED STATES PATENTS

| | | | |
|---|---|---|---|
| 2,841,867 | 7/1958 | Padgett | 30/41.6 |
| 3,392,443 | 7/1968 | Kawano | 30/34.1 |
| 3,774,300 | 11/1973 | Konig | 30/34.1 |
| 3,783,508 | 1/1974 | Brown | 30/43.92 |

FOREIGN PATENTS OR APPLICATIONS

| | | | |
|---|---|---|---|
| 2,058,646 | 5/1972 | Germany | 30/34.1 |
| 2,360,300 | 6/1974 | Germany | 30/34.1 |

*Primary Examiner*—Gary L. Smith
*Attorney, Agent, or Firm*—Leydig, Voit, Osann, Mayer & Holt, Ltd.

[57] ABSTRACT

An electric shaver having a trimmer wherein a base plate member is provided as fixed to shaver body between shaving and trimming elements and their driving power source allowing driving end of the source to pass therethrough. Stationary trimmer blade is fixed to the base plate member while slidably holding movable trimmer blade between them. Driving member coupled to the driving source end for reciprocally driving the movable trimmer blade and inner shaving blade assembly is supported on the base plate member slidably as thereby guided.

7 Claims, 8 Drawing Figures

ELECTRIC SHAVER WITH LONG HAIR TRIMMER

This invention relates to electric shavers and, more particularly, to small electric shavers specifically for ladies and having a trimmer.

A shaving head for the small shaver of the kind referred to has already been suggested in U.S. Pat. No. 3,859,697 of Dec. 24, 1974. However, the electric shaver of such structure as shown in this U.S. Patent has defects that, as a U-shaped stationary trimmer blade is secured to the upper part of electric shaver body so that a movable blade may be slidably fitted to the upper surface of the stationary trimmer blade, it is difficult to manufacture the stationary trimmer blade and, as the movable blade is located to be disposed on the fixed blade, user's skin will be likely to be hurt during the use. The present invention has been suggested to improve the shavers in respect of such defects as above.

According to the present invention, the above problems have been successfully solved by providing a structure wherein a base plate member is fixed to an intermediate position in the electric shaver body, a stationary trimmer blade is fixed to the base plate member, a reciprocal driving member capable of making a reciprocal sliding motion is supported by the base plate so that a movable trimmer blade will be driven by the reciprocal driving member.

A primary object of the present invention is to provide an electric shaver wherein component parts are reduced in number so that manufacturing cost will be lowered and yet assembling accuracy of these parts is high.

Another object of the present invention is to provide an electric shaver having a trimmer which will not hurt the user's skin during the use.

A further object of the present invention is to provide an electric shaver which can be made small as a whole by reducing the height of the electric shaver body.

Another object of the present invention is to provide an electric shaver provided with a cut hair collector.

The present invention shall be explained in the followings with reference to a preferred embodiment illustrated in accompanying drawings, in which.

Figure 1:
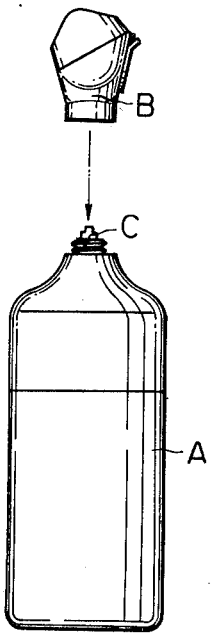
FIG. 1 shows an electric shaver of the present invention with a shaving head disassembled from shaver body.

Referring first to FIG. 1 showing an electric shaver of the present invention, A designates an electric shaver body in which a battery or rechargeable battery with a charger, motor, control switch and the like are contained and a shaving head B of the electric shaver is coupled to the body A as screwed to a connecting part C in the upper part of the body A so that the head B will be operatively connected to the motor in the body.

Figure 2:
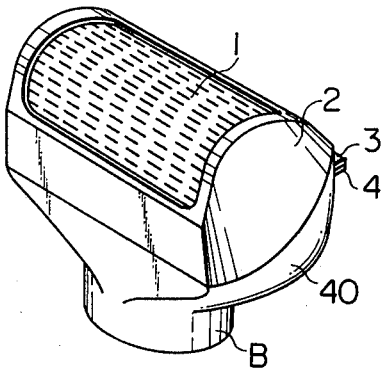
FIG. 2 is a perspective view of the shaving head in FIG. 1.

Referring next to FIG. 2 showing the shaver head B, a frame 2 to which an outer, thin net blade 1 is secured into an arch configuration is fitted to the upper surface of a case 40 of the shaving head B and a trimmer comprising a stationary trimmer blade 3 and a movable trimmer blade 4 is provided in the head B so as to expose their trimming edges at a side part of the case 40.

Figure 3:
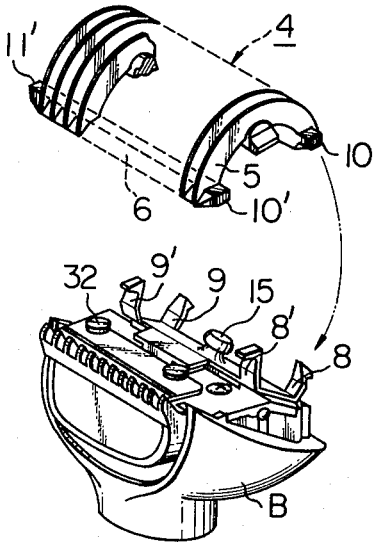
FIG. 3 is a perspective view of the shaving head with an outer net-blade frame removed and an inner blade assembly disassembled for showing internal structure of the shaving head of FIG. 2.
Figure 4:
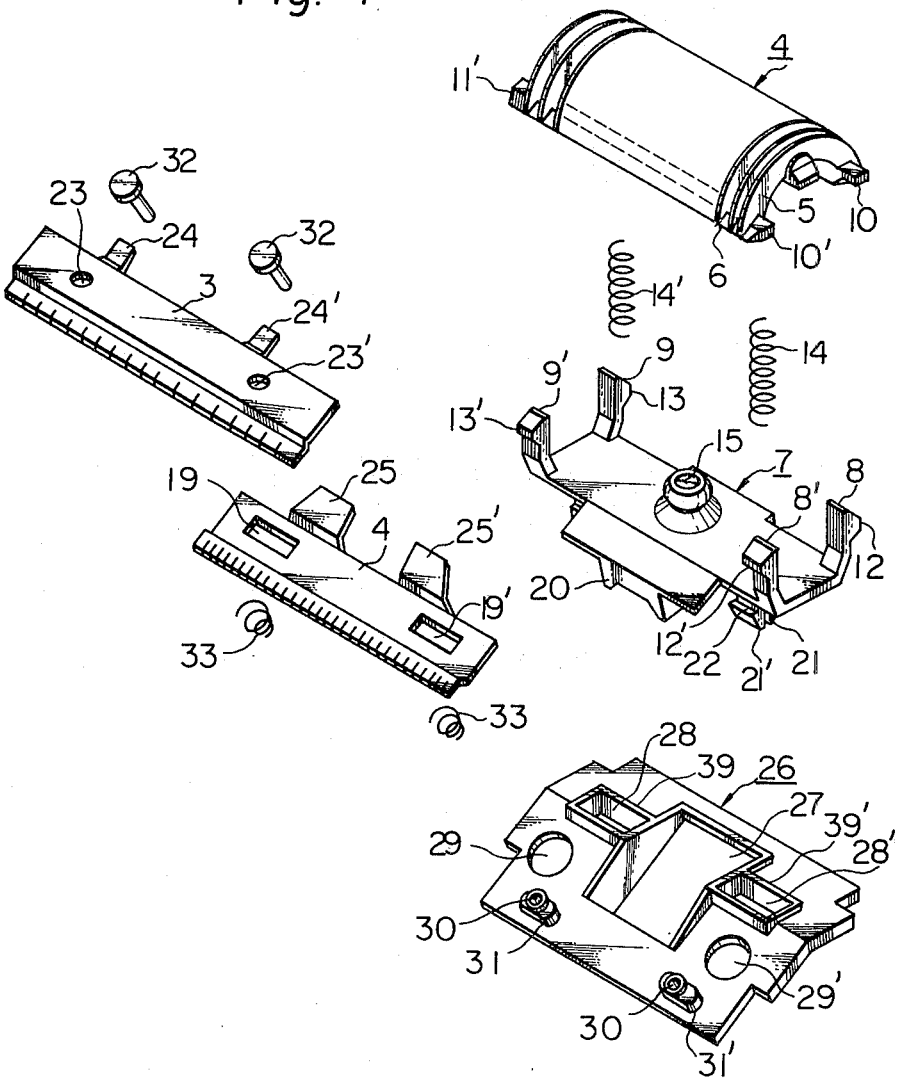
FIG. 4 is a perspective view of respective members in the shaving head as disassembled of FIG. 2.
Figure 6:
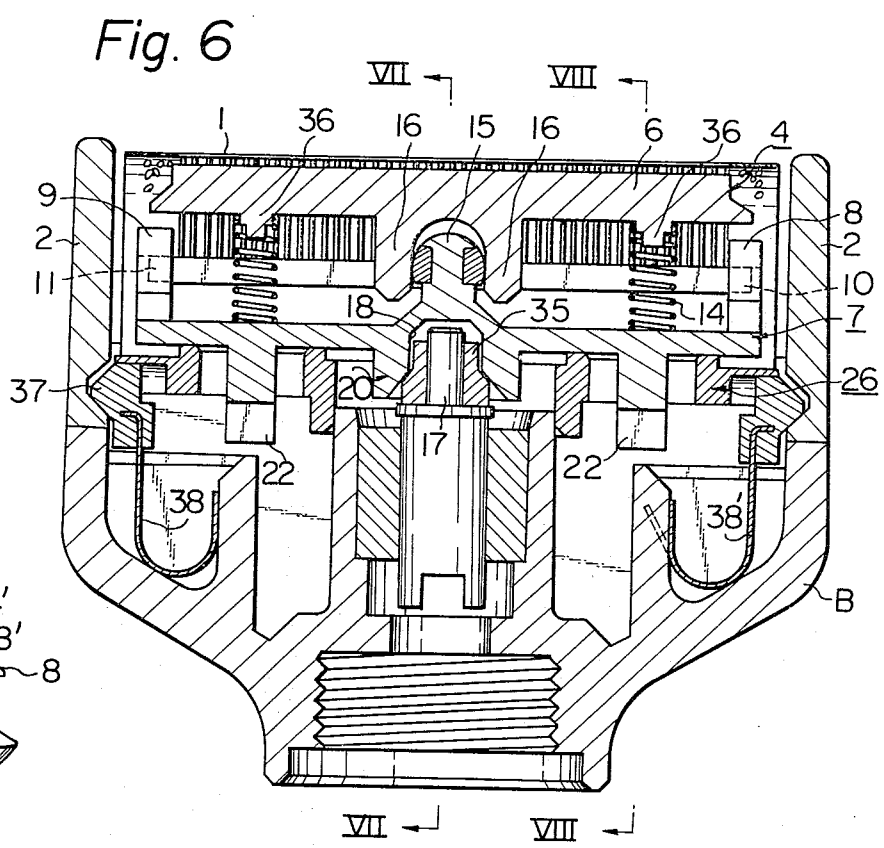
FIG. 6 is a vertically sectioned view as magnified of the shaving head, as assembled, along longitudinal axial line of the electric shaver of the present invention.
Figure 5:
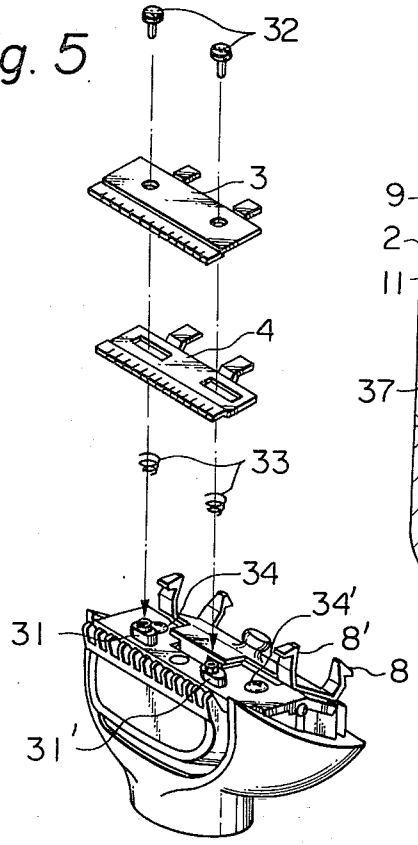
FIG. 5 is an explanatory view for an assembly of trimmer blades in the shaving head.

As shown in FIG. 3 showing the internal structure of the head B by removing the frame 2 and disassembling an inner blade assembly 5 and also in FIG. 4 showing respective component members of the structure as disassembled, the inner blade assembly 5 comprises a plurality of semicircular blades 5' supported on a supporting frame 6 made of plastics as respectively spaced in axial direction of the frame with their semi-circular edges directed toward the outer blade 1, two pairs of axial projecting parts 10, 10' and 11, 11' to be engaged respectively with two pairs of engaging arms 8, 8' and 9, 9' provided to project upward at both ends of a reciprocal driving member 7 made of plastics are provided on both end surfaces of the lower part of the supporting frame 6, while wedge-shaped projections 12, 12' and 13, 13' are provided outside the engaging arms 8, 8' and 9, 9' respectively, so that in assembling the inner blade assembly 5 to the driving member 7 the engaging arms 8, 8' and 9, 9' pushed upward respectively along inside the projecting parts 10, 10' and 11, 11' will resiliently bow toward each other and thereafter expand away to cause the projections 12, 12' nd 13, 13' to be captively engaged to upper corners of the projecting parts 10, 10' and 11, 11', respectively. In such case, springs 14 and 14' are preliminarily inserted between the upper surface of the reciprocal driving member 7 and the lower surface of the inner blade assembly 5 as seen in FIG. 6 so as to resiliently urge the inner blade body assembly 5 against inner surface of the outer net blade 1. Further, a driving projection 15 to be fitted between a pair of opposing legs 16 (see FIG. 6) provided on the lower surface of the inner blade assembly 5 is provided on the upper surface of the driving member 7. A box-shaped body 20 having a cam part 18 in which the tip of an eccentric rotary shaft 17 is to be inserted is provided on the lower surface of the driving member 7 (see also FIG. 6). Further, two pairs of legs 21 and 21' are provided to project downward adjacent both ends of the driving member 7 and a projection 22 is provided outside each of the legs 21 and 21'.

Further with reference to FIG. 4, the stationary blade 3 of the trimmer is provided with fixing holes 23 and 23' and guiding pawls 24 and 24', and the movable blade 4 is provided with guiding slots 19 and 19' and guiding pawls 25 and 25'.

A base plate 26 is a roof-shaped member made of plastics having two angled planes communicated substantially at central axial line, which is provided with a central aperture 27 for receiving the eccentric rotary shaft 17, with axially extending slots 28 and 28' on both sides of the aperture 27 and further with fitting holes 29 and 29' for mounting the base plate 26 to the shaving head B and short pillars 31 and 31' having respective holes 30 and 30' for fixing the stationary trimmer blade 3 between the holes 29 and 29' and an edge in one of the two planes. These short pillars 31 and 31' have steps formed respectively in the middles so that, in case the stationary blade 3 is fitted at its holes 23 and 23' to the pillars 31 and 31' of the base plate 26, a slight clearance will be made from the plane of the base plate 26 by these steps. As described later, the movable blade 4 is inserted between this stationary blade 3 and the plane of the base plate 26. 32 are pins to be inserted in the holes 30 and 30' of the base plate 26 for fixing thereto the stationary blade 3 and 33 are springs to be fitted about the pillars 31 and 31'.

The assembly of the trimmer blades 3 and 4 and reciprocal driving member 7 with the base plate 26 shall be explained in the followings.

First, the respective springs 33 are fitted around each of the short pillars 31 and 31' of the base plate 26, then the movable blade 4 is loosely fitted with the guide slots 19 and 19' to the pillars 31 and 31', the stationary blade 3 is fitted over the movable blade 4 and onto the stepped parts of the pillars 31 and 31' so that the pillars will partly nest in the holes 23 and 23' of the blade 3, and the pins 32 are inserted in the respective holes in the pillars 31 and 31' to tightly hold the blade 3 in position. The reciprocal driving means 7 is then mounted to the base plate 26 so that the downward projecting legs 21 and 21' will be urged into the guide slots 28 and 28' of the base plate 26, in which the legs 21 and 21' will expand after being inserted into the respective slots and the projecting parts 22 will engage with the lower edges of the guiding slots 28 and 28', thereby the driving member 7 will be mounted to the base plate 26 slidably along the slots 28 and 28' without being pulled out of the base plate 26. In this case, the pawls 25 and 25' of the movable blade 4 will contact both sides of the box-shaped body 20 in the lower part of the driving member 7 so as to be driven together with the motion of the driving member 7. The base plate 26 is fixed to the shaving head B by means of screws 34 and 34' respectively screwed through the mounting holes 29 and 29' of the plate into corresponding holes made in the shaving head body (see FIG. 8).

Figure 7:
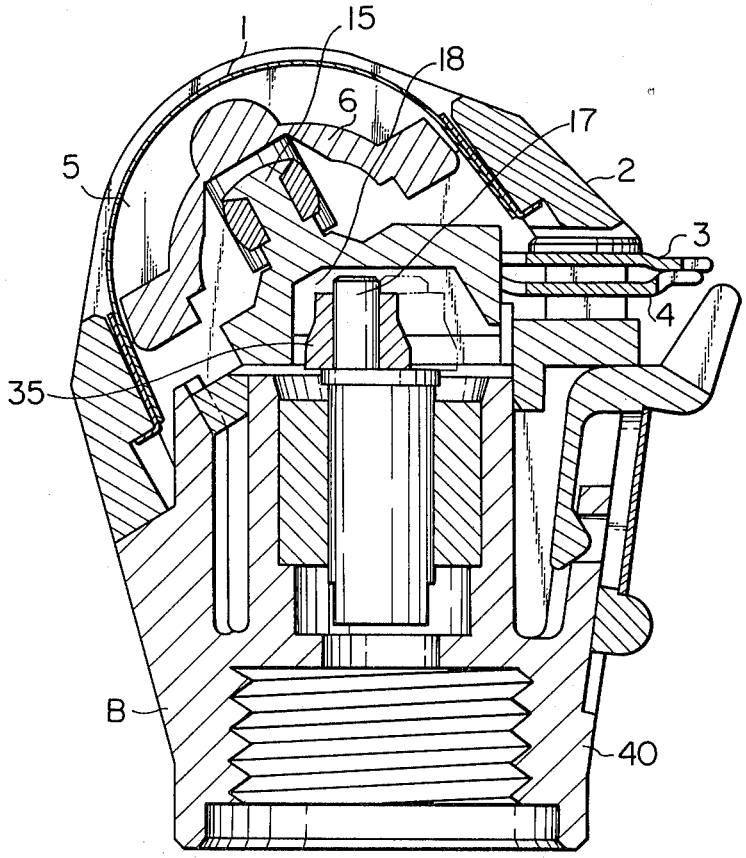
FIG. 7 is a cross sectional view of the shaving head on line VII—VII in FIG. 6.
Figure 8:
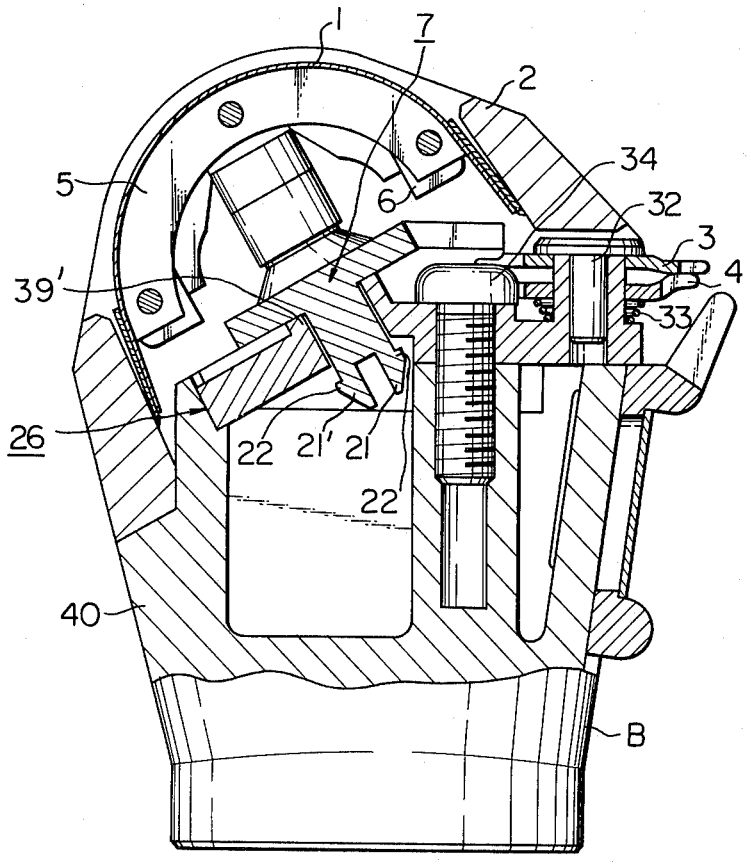
FIG. 8 is a cross sectional view of the shaving head on line VIII—VIII in FIG. 6.

The inner blade assembly 5 is coupled to the driving member 7 by engaging the projecting parts 10, 10' and 11, 11' at both ends of the assembly 5 respectively with the engaging arms 8, 8' and 9, 9' on the driving member 7 as before described. While in the illustrated case the projections 12, 12' and 13, 13' of the arms 8, 8' and 9, 9' are caused to slide along inside surfaces of the projecting parts 10, 10' and 11, 11' as the arms are thereby bowed inward with their own resiliency and the projections 12 – 13' are to catch the projected parts 10 – 11' from the inside of the space between the projected parts 10 – 11', it is also possible to so form the arms 8 – 9' as well as their projections 12 – 13' and the projecting parts 10 – 11' that the projecting parts 10 – 11' will be captively held from outside between the respective pairs of arms 8, 8' and 9, 9'. In both occasions, the captive engaging operation is substantially the same. The state in which the inner blade assembly 5 is coupled to the driving member 7 and associated with the frame 2 having the outer net blade 1 is shown in FIGS. 6 through 8.

Referring now to FIG. 6, the eccentric rotary shaft 17 is provided with a ring 35 on the periphery and is inserted in the cam part 18 on the lower surface of the driving member 7. The driving projection 15 on the driving member 7 is inserted in turn between the fitting legs 16 provided on the lower surface of the inner blade assembly 5. The upper part of the springs 14 for pushing up the inner blade assembly 5 is fitted to projection 36 on the lower surface of the frame of the assembly 5 so as to be compressed between the frame and the driving member 7. Projecting members 37 and 37' for resiliently engaging with the shaving head B are biased to project outward respectively by springs 38 and 38' housed in the case 40 of the head on both sides of the base plate 26. Further, upright edges 39 and 39' are provided respectively on the peripheries of the guiding slots 28 and 28' provided in the base plate 26 as seen in FIG. 4 so that cut hairs will collect on the base plate 26 between these edges 39 and 39' and peripheral edge of the case 40 of the head B. In this case, the lower surface of the driving member 7 is urged to slidingly engage the upright edges 39 and 39'0 by the springs 14 to tightly close the guide slots 28 and 28', whereby cut hairs are prevented from further entering inside the shaving head B. In order to remove the cut hairs, the frame 2 may be removed from the case 40 against the resilient holding force of the projecting members 37 and 37'.

The operation of the electric shaver of the present invention shall be explained in the followings. When the eccentric rotary shaft 17 is rotated within the cam part 18 in the member 7 by the motor actuated by the electric source (not shown) provided within the shaver body A, the reciprocal driving member 7 will be reciprocated as guided along the slots 28 and 28' in the base plate 26 so that the inner blade assembly 5 will be reciprocated by the driving projection 15 provided in the driving member 7. As the pawls 25 and 25' of the movable blade 4 are in contact with the side walls of the box-shaped body 20 of the member 7 to hold it between them, the movable blade 4 will be also reciprocated together with the inner blade assembly 5. The trimmer blades may be used for rough shaving or cutting of hairs and the outer net blade may be used for a finishing in association with the inner blade assembly.

In the present invention, as has been described in the foregoings, the base plate 26 is adapted to have such functions concurrently that the same prevents cut hairs or even dusts from entering into the shaver body, supports the trimmer blades as well as the inner blade assembly and further acts as guide means for the reciprocal driving member and, therefore, it becomes possible to reduce required number of parts for such functions. Yet, as the trimmer blades are not utilized as a supporting base for other members, in contrast to the structure as shown in the U.S. Pat. No. 3,855,697 already referred to, the trimmer blades can be substantially freely designed irrespective of the other members and thus their manufacturing can be made easier.

As the trimmer's movable blade is disposed and driven behind the stationary trimmer blade, further, the trimmer in the shaver of the present invention is safer to handle and use than the known ones such as in the U.S. patent. Further, as the inner shaving blades and trimmer blades are operated by driving the reciprocal driving member with the eccentric rotary shaft, the shaving head of the shaver can be made smaller in its height so as to allow the shaver to be minimized in size.

As the upright edges are provided around the guide slots 28 and 28' in the base plate, cut hairs are little likely to enter the eccentric rotary shaft side and can be effectively collected between the upper surface of the base plate and the peripheral edge of the shaving head.

We claim:

1. An electric shaver comprising an inner blade assembly of a plurality of inner blades supported as spaced on an inner blade supporting frame, a trimmer including a stationary trimming blade and a movable trimming blade slidable along lower surface of said stationary blade, a source of driving power, a reciprocal driving member supporting said inner blade assembly and coupled to said movable trimming blade, means for transmitting said driving power to said reciprocal driving member for reciprocally driving the same, a base member supporting thereon the reciprocal driving member, said stationary trimming blade being fixed to said base member, a shaver body case housing therein respective said elements, and a supporting frame for an outer blade having a plurality of hair introducing holes and cooperating with the inner blade assembly, said outer blade supporting frame being detachably mounted to upper part of said body case.

2. The shaver according to claim 1 wherein said driving power source is a motor having a rotary shaft, and said transmitting means comprises an eccentric rotary member rotated by said motor shaft and a cam part formed in said reciprocal driving member so as to be coupled to said eccentric rotary member.

3. The shaver according to claim 1 wherein said body case comprises a lower case member housing therein said driving power source and an upper case member housing therein said inner blade assembly, trimmer, reciprocal driving member, driving power transmitting means and base member and being detachably mounted to upper part of said lower case member.

4. The shaver according to claim 1 wherein said reciprocal driving member is provided with at least a projection on the side facing said base member, said projection being loosely fitted in at least a slot made in the base member so that the driving member will be supported on the base member reciprocally movably along upper surface of the base member.

5. The shaver according to claim 1 wherein said reciprocal driving member is provided on respective corners with an engaging arm extending upward and having a projection adjacent upper end, said inner blade assembly is biased toward said outer blade by at least a compression spring inserted between the assembly and the reciprocal driving member, and said inner blade supporting frame is captively engaged to respective said projections of said engaging arms of the reciprocal driving member so that the inner blade assembly will be movable in vertical directions with respect to the reciprocal driving member by a predetermined stroke.

6. The shaver according to claim 4 in which said base member is provided with an upright edge surrounding said slot on upper surface of the member, and said reciprocal driving member is biased by said compression spring slidably against said upright edge on lower surface side so as to substantially tightly close the slot with respect to cut hairs while providing a cut hair reservoir around the upright edge.

7. An electric shaver having a trimmer comprising, in combination, a shaver body opened at an axial end, a driving means housed in said body and having an output end disposed at said opened end of the body, a base plate substantially closing the opened end of the body while exposing said output end, a stationary trimming blade fixed to said base plate through a clearance between them with a comb shaped blade edge disposed accessible from exterior, a movable trimming blade disposed in said clearance slidably with a comb shaped blade edge disposed in alignment with said accessible blade edge as resiliently butted thereto, a driving member supported on the base plate reciprocally slidably in parallel directions to said aligned trimming blade edges, said reciprocal driving member being coupled to said movable trimming blade for driving the same in said directions, means interposed between the output end of the driving means and the reciprocal driving member for transmitting to the member motions of the driving means, an outer blade assembly of a thin net shaped outer blade mounted in semicylindrical shape axially extending in said directions to a frame detachably fitted to the opened end of the shaver body, and an inner blade assembly of a plurality of semicircular blades secured as axially spaced to a frame supported resiliently on the base plate, said inner blade assembly being operatively coupled to the reciprocal driving member so that said semicircular blades will resiliently abut edgewise against and slide along inner surface of said semicircular outer net blade.

* * * * *